US009161672B2

(12) United States Patent
Pisacane

(10) Patent No.: US 9,161,672 B2
(45) Date of Patent: Oct. 20, 2015

(54) LAMINATED FLAT MOPHEAD

(75) Inventor: Fred Pisacane, San Diego, CA (US)

(73) Assignee: Foamted International Co., Ltd., Oceanside, CA (US)

( * ) Notice: Subject to any disclaimer, the term of this patent is extended or adjusted under 35 U.S.C. 154(b) by 0 days.

(21) Appl. No.: 12/900,933

(22) Filed: Oct. 8, 2010

(65) Prior Publication Data

US 2011/0056040 A1 Mar. 10, 2011

Related U.S. Application Data

(63) Continuation of application No. 11/401,593, filed on Apr. 10, 2006, now abandoned.

(60) Provisional application No. 60/669,513, filed on Apr. 8, 2005.

(51) Int. Cl.
*A47L 25/00* (2006.01)
*A47L 13/254* (2006.01)

(52) U.S. Cl.
CPC ..... *A47L 13/254* (2013.01)

(58) Field of Classification Search
USPC ..... 15/228, 244.1, 244.3, 244.4
See application file for complete search history.

(56) References Cited

U.S. PATENT DOCUMENTS

| | | | | |
|---|---|---|---|---|
| 5,419,015 | A * | 5/1995 | Garcia | 15/228 |
| 5,522,110 | A * | 6/1996 | Borofsky | 15/116.2 |
| 5,671,497 | A * | 9/1997 | Abdo | 15/144.1 |
| 6,148,465 | A * | 11/2000 | Hsieh et al. | 15/118 |
| 7,690,069 | B2 * | 4/2010 | Chen et al. | 15/115 |
| 8,166,597 | B2 * | 5/2012 | Levitt et al. | 15/118 |
| 2011/0239393 | A1 * | 10/2011 | Nobile et al. | 15/244.1 |

* cited by examiner

*Primary Examiner* — Lee D Wilson
*Assistant Examiner* — Shantese McDonald
(74) *Attorney, Agent, or Firm* — Zeman-Mullen & Ford, LLP

(57) ABSTRACT

A laminated flat mop head which includes a flat foam layer laminated with a fabric material without using glue or adhesive.

6 Claims, 3 Drawing Sheets

LAMINATED FLAT MOPHEAD

CROSS-REFERENCE TO RELATED APPLICATIONS

This application is a continuation that claims priority to, and the benefit of, U.S. Ser. No. 11/401,593 filed Apr. 10, 2006, which application claims priority to, and the benefit of, U.S. Provisional Application No. 60/669,513, filed Apr. 8, 2005 which are hereby incorporated by reference in their entirety.

FIELD OF INVENTION

The present invention is directed to a flat foam mop head that is laminated with various fabrics without using glue or an adhesive in order to create a more durable foam mop head. More particularly, the present invention is directed to a flat foam mop head that is laminated with a double-knit, snag-resistant polyester fabric or a micro fiber textile without using glue or an adhesive to create a durable, long lasting foam mop head.

BACKGROUND OF THE INVENTION

Mop heads made of foam have existed for sometime due to their ability to easily absorb and retain liquids during mopping. Such mop heads may be permanently attached to the end of a mop or they may be removable and replaceable. However, whether or not the foam mop heads are permanently attached or replaceable, minute particles and/or pieces of the foam mop heads become separated from the mop head over time during normal wearing of the mop head. As a result, the utility of the mop head decreases over time. In addition, the minute particles and/or pieces of the foam mop heads may result in further contamination of a site or space for which the mop is being used to clean. Accordingly, there is a need for a foam mop head with improved durability where particle removal that results from the wearing of the mop is decreased.

SUMMARY OF THE INVENTION

The present invention is directed to a foam mop head having increased durability which results from decreasing particle removal of the mop head during wear by laminating the foam mop head with a fabric material without using glue or adhesive. Avoiding glue or adhesive as part of the lamination process further decreases potential contamination to the cleaning site that might result from the degradation of the glue or adhesive over time.

The laminated foam mop head includes a flat foam layer having a top surface and a bottom surface and a fabric material laminated to at least one of the top and bottom surfaces without using glue or adhesive. In one exemplary embodiment of the invention, the fabric material laminated to the flat foam layer comprises a double-knit, snag-resistant polyester fabric. In another exemplary embodiment of the invention, the fabric material laminated to the flat foam layer comprises a micro fiber textile.

The laminated foam mop head of the present invention may be permanently attached to the end of the mop or alternatively, it may be removable and replaceable. The fabric material may be laminated to the flat foam layer either before or after attachment of the mop head to the bottom of a flat mop end. Lamination of the fabric material to the flat foam layer before attachment of the mop head to the mop end would provide a disposable mop head that can be replaced with another laminated fabric or textile mop head that is attachable to the bottom of the mop end.

DETAILED DESCRIPTION OF EXEMPLARY EMBODIMENTS

Figure 1:
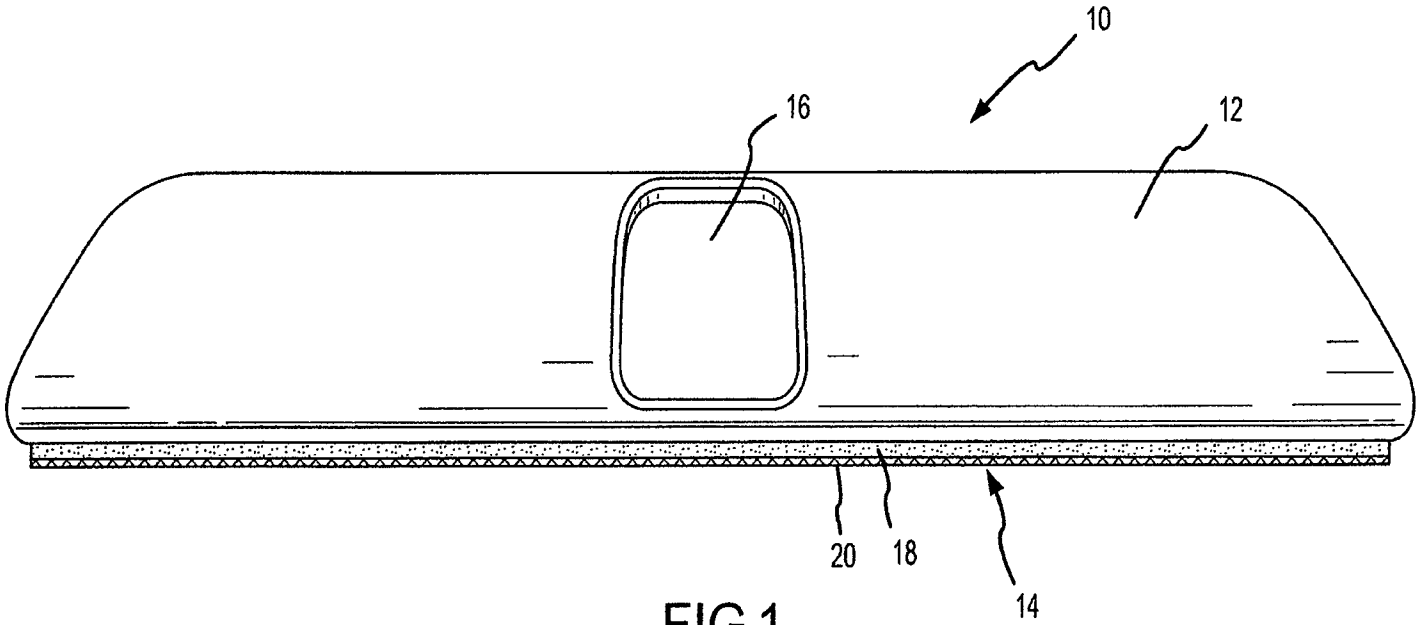
FIG. 1 is a top perspective view of a flat mop head in accordance with the invention.

FIG. 1 shows a top perspective view of a flat mop head 10 in accordance with the invention. Flat mop head 10 includes a top 12 and a bottom 14. Top 12 of flat mop head 10 also includes an opening 16 for a mop handle (not show) which enables flat mop head 10 to be securely attached to the mop handle during use. Flat mop head 10 further includes a flat foam layer 18 and at least one fabric material 20 laminated to the flat foam layer 18 without using glue. Fabric material 20 may be laminated to the top and/or bottom of flat foam layer 18 but is preferably at least laminated to the bottom of the flat foam layer 18 which comes into contact with the surface to be mopped or cleaned.

Figure 2:
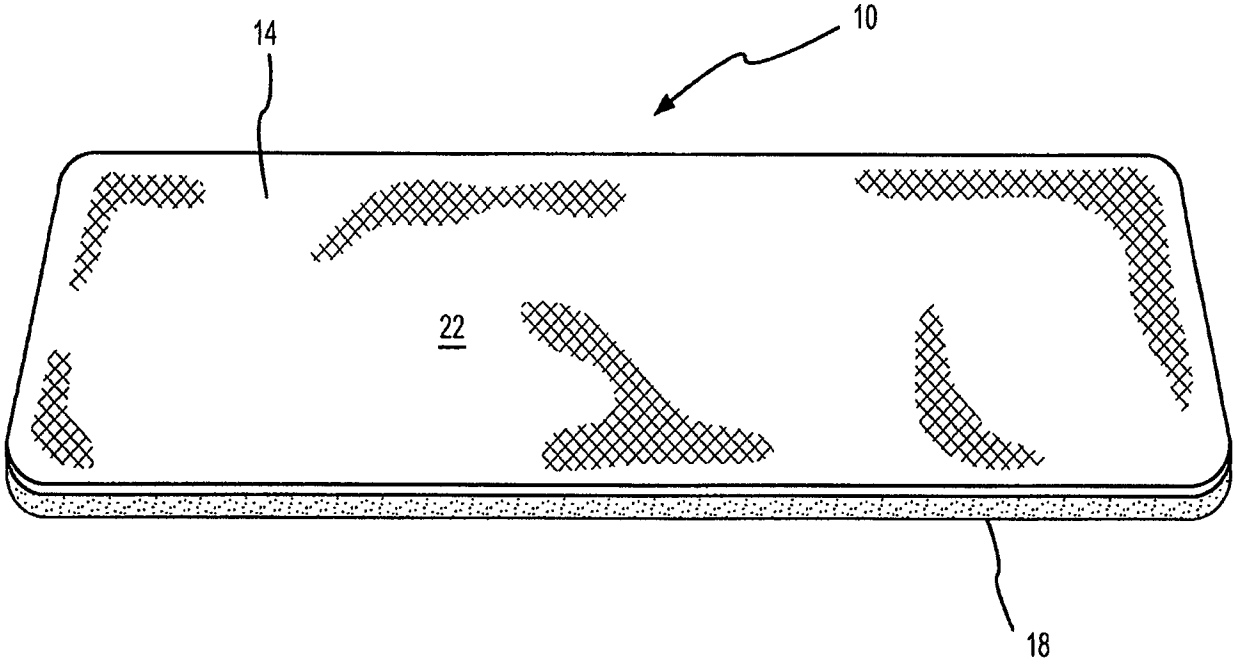
FIG. 2 is a bottom perspective view of the flat mop head shown in FIG. 1 with a laminated double-knit snag-resistant polyester fabric attached to the bottom of the flat mop head.
Figure 3:
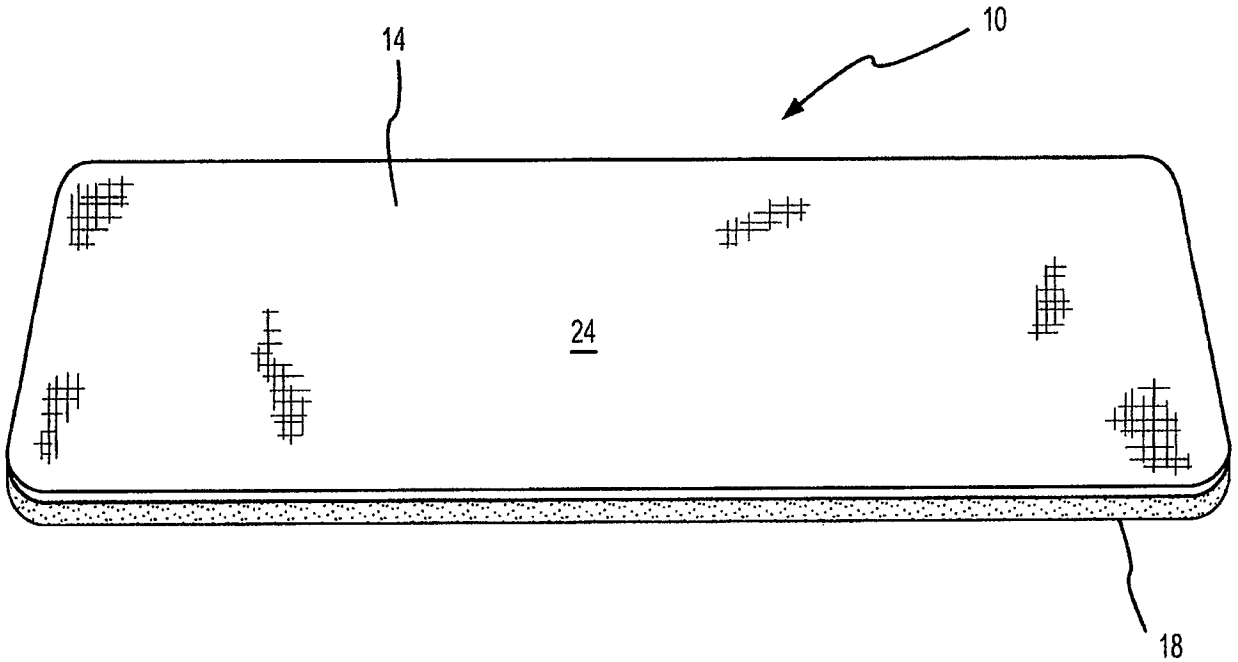
FIG. 3 is a bottom perspective view of the flat mop head shown in FIG. 1 with a laminated micro fiber textile attached to the bottom of the mop head.

FIG. 2 is a bottom perspective view of the flat mop head 10 shown in FIG. 1 with a laminated double-knit snag-resistant polyester fabric 22 attached to the bottom of the flat mop head and FIG. 3 is a bottom perspective view of the flat mop head 10 shown in FIG. 1 with a laminated micro fiber textile attached to the bottom of the mop head 10. Lamination of the fabric material 20 to the flat foam layer 18 without using glue or adhesive reduces the creation of fine particles or pieces being worn from the flat foam layer 18 and further reduces the chance of contaminating the site or space that is being cleaned with the mop head 10.

Lamination of the flat foam layer 18 with the fabric material 20 may occur either before or after attachment to the mop head. If lamination occurs before attachment to the mop head, a laminated disposable mop head is created that can be easily removed and replaced.

Fabric material 20 may be laminated to flat foam layer 18 by using any known means of uniting superimpose layers that does not include a glue or adhesive, such as, for example, heat and pressure applied to the superimposed layers.

The invention claimed is:

1. A flat mop head comprised of a flat foam layer having a top surface with an opening therein and a continuous bottom surface without openings and at least one fabric material laminated to the bottom surface of the flat foam layer without using an adhesive.

2. The flat mop head of claim 1 wherein the fabric material comprises a double-knit, snag-resistant, polyester fabric.

3. The flat mop head of claim 1 wherein the fabric material comprises a micro fiber textile.

4. A flat mop head comprised of:

a flat foam layer having a top surface with an opening therein and a continuous bottom surface without openings; and at least one fabric material laminated to the bottom surface of the flat foam layer without using an adhesive wherein the interface between the fabric material and the flat foam layer is permeable.

5. The flat mop head of claim 4 wherein the fabric material comprises a double-knit, snag-resistant, polyester fabric.

6. The flat mop head of claim 4 wherein the fabric material comprises a micro fiber textile.

* * * * *